US006557642B2

(12) United States Patent
Head

(10) Patent No.: US 6,557,642 B2
(45) Date of Patent: May 6, 2003

(54) SUBMERSIBLE PUMPS

(75) Inventor: Philip Head, Ascot (GB)

(73) Assignees: XL Technology LTD, Ascot (GB); TSL Technology, Southampton (GB)

( * ) Notice: Subject to any disclaimer, the term of this patent is extended or adjusted under 35 U.S.C. 154(b) by 0 days.

(21) Appl. No.: 09/795,922

(22) Filed: Feb. 28, 2001

(65) Prior Publication Data

US 2001/0050173 A1 Dec. 13, 2001

(30) Foreign Application Priority Data

Feb. 28, 2000 (GB) ..... 0004487
Mar. 7, 2000 (GB) ..... 0005330

(51) Int. Cl.[7] ..... E21B 43/00
(52) U.S. Cl. ..... 166/381; 166/665
(58) Field of Search ..... 166/381, 66.5, 166/66, 666, 66.7, 68, 105

(56) References Cited

U.S. PATENT DOCUMENTS 4,191,248 A 3/1980 Heubsch et al.
4,687,054 A * 8/1987 Russell et al. ..... 166/66.4
5,542,472 A 8/1996 Pringle et al.
5,971,072 A * 10/1999 Huber et al. ..... 166/297
6,032,734 A * 3/2000 Telfer ..... 166/66.5
2001/0035288 A1 * 11/2001 Brockman et al. ..... 166/65.1

FOREIGN PATENT DOCUMENTS

GB 2314363 A 12/1997
GB 2334540 A 8/1999
WO WO 98/46854 A1 10/1998

* cited by examiner

*Primary Examiner*—William Neuder
(74) *Attorney, Agent, or Firm*—Herbert Dubno

(57) ABSTRACT

An oil flow line and power device system has a tube for the transportation of oil and a power device which can be received in the tube. The tube is provided with an electric power transmission line extending along at least some of the length and has a first power transfer unit which can cooperate with a second power transfer unit on the power outlet device such that the other power transfer units cooperate to transfer power from the transmission line to the power device.

13 Claims, 15 Drawing Sheets

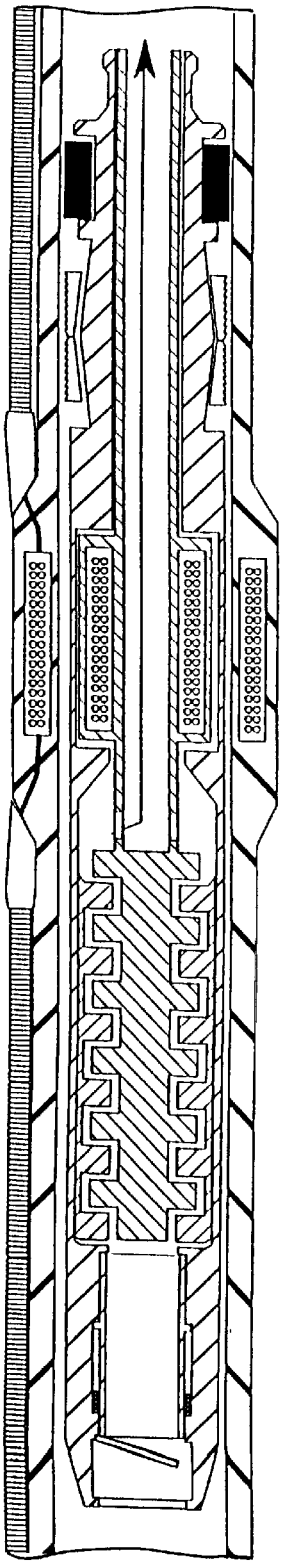
FIG. 19
FIG. 22
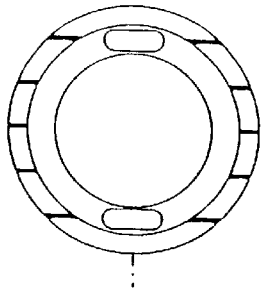
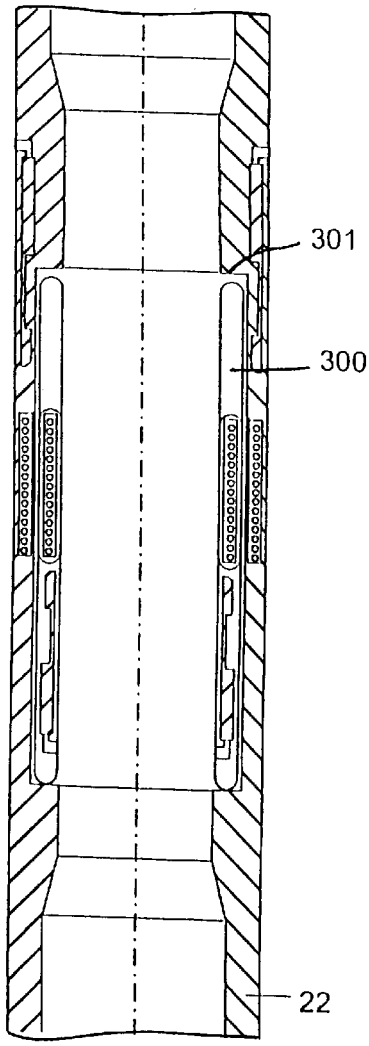
FIG. 23

SUBMERSIBLE PUMPS

FIELD OF THE INVENTION

This invention relates to submersible pumps and the like, in particular the deployment and retrieval of semi-permanent assemblies into wells and pipelines, especially electrically powered assemblies such as electric submersible pumps (ESPs) and flow regulators based on permanent magnet brushless motors.

BACKGROUND OF THE INVENTION

A conventional electrical submersible pump installation for oil wells is deployed at the end of a production tubing, the tubing being used to conduct the pumped fluids to surface. The tubing consists of jointed sections, to which the electrical power cable is externally strapped. The motor and centrifugal or positive displacement pump are assembled at the bottom of the tubing, normally with the pump above the motor, so it can lift fluids via a discharge head directly into the tubing.

The ESP must be maintained from time to time. This requires a so-called work-over rig and crew which can pull up and dismantle the sections of tubing from the well and detach the cable to retrieve the pump. The repaired or replaced pump is deployed back into the well as for a new installation, re-making the tubing and affixing the cable. Since there is a high likelihood of damaging the cable and its connectors, these are often replaced during the work-over. This type of work-over is a time consuming and expensive exercise, and it is often done to a fixed schedule that leaves failed installations until the next scheduled slot, with consequent lengthy periods without production.

An alternative known method of ESP installation disclosed in GB 2 318 167 uses coiled tubing. In this the power cable is pre-installed into the continuous tubing and makes on to the motor, which is now above the pump. The fluids are lifted in the annulus between the tubing and the well casing. Since the ESP is reeled into and out of the well, work-over costs are significantly reduced compared to the conventional means of installation. Nevertheless the method requires the use of a reeled tubing rig and remains expensive.

It is an objective of this invention to allow convenient recovery of components disposed in a well or pipeline.

SUMMARY OF THE INVENTION

According to the present invention, there is provided an oil flow line and powered device system comprising:

a tube for the transportation of oil, and at least one powered device, the powered device being disposable in the tube, the tube having an electrical power transmission means disposed along at least some of its length, the tube having a first power transfer means, and the powered device having a second power transfer means, the first power transfer means and second transfer means being capable of co-operating so as to transfer power from one to the other.

Preferably the first power transfer means act as a stator of a motor, and the second power transfer means act as a rotor of a motor.

Preferably the inner surface of the tube includes at least one locating means for locating the powered device at a particular position in the tube Alternatively or additionally the powered device includes a gripping means to secure itself to the inner surface of a tube.

According to another aspect of the present invention, there is provided a method of delivering or retrieving a powered device in a powered device and flow line system oil flow line and powered device system comprising:

a tube for the transportation of oil, and at least one powered device, the powered device being disposable in the tube, the tube having an electrical power transmission means disposed along at least some of its length, the tube having a first power transfer means, and the powered device having a second power transfer means, the first power transfer means and second transfer means being capable of co-operating so as to transfer power from one to the other, including the step of applying fluid pressure to the flow line.

According to another aspect of the present invention, there is provided a method of delivering or retrieving a powered device in a powered device and flow line system comprising:

a tube for the transportation of oil, and at least one powered device, the powered device being disposable in the tube, the tube having an electrical power transmission means disposed along at least some of its length, the tube having a first power transfer means, and the powered device having a second power transfer means, the first power transfer means and second transfer means being capable of co-operating so as to transfer power from one to the other, including the step of operating a traction means to interact between the tube and the powered device.

According to a further aspect of the present invention, there is provided a tube for an oil flow line and powered device system the oil flow line and powered device system comprising:

a tube for the transportation of oil, and at least one powered device, the powered device being disposable in the tube, the tube having an electrical power transmission means disposed along at least some of its length, the tube having a first power transfer means, and the powered device having a second power transfer means, the first power transfer means and second transfer means being capable of co-operating so as to transfer power from one to the other.

According to a further aspect of the present invention, there is provided a powered device for an oil flow line and powered device system the oil flow line and powered device system comprising:

a tube for the transportation of oil, and at least one powered device, the powered device being disposable in the tube, the tube having an electrical power transmission means disposed along at least some of its length, the tube having a first power transfer means, and the powered device having a second power transfer means, the first power transfer means and second transfer means being capable of co-operating so as to transfer power from one to the other.

The powered device may include a traction means which interacts between the tube and the powered device so as move the powered device along the flow line.

It is a further objective of this invention that said docking ports be addressable when required to permit individual control.

In this way, the electrical power cable, its connectors, and production tubing remains in the well during an entire ESP work-over. Docking ports are used to station and operate modular pumps, valves, sensors and/or other actuators at one or more locations, said docking ports possibly being addressable when required to permit individual control.

The modules may be recovered by the production fluids themselves as an alternative or in addition to special hydraulic fluids. These modules are recovered by re-circulating the said fluids using a permanent flow path in or attached to the production tubing. The modules are also recoverable by a wireline or slickline operation for back-up or primary means of recovery, and by electric powered traction tools.

Electrical connections between said modules and docking ports are not required. Rotary or linear motor action be developed using stator coils mounted in or on the fixed part of the downhole assembly and permanent magnets mounted in or on the said modules. The said modules may be individually controlled from the same power supply.

BRIEF DESCRIPTION OF THE DRAWINGS

The invention will now be described with refernce to the accompanying drawings, given as examples and not intended to be limiting, in which.

FIGS. 14 to 19 show side views of a further embodiments of the pumping module;

FIGS. 22 to 24 show side views and a section of a docked sensor module, with charging and signal transfer;

DESCRIPTION OF THE PREFERRED EMBODIMENT

Figure 1:
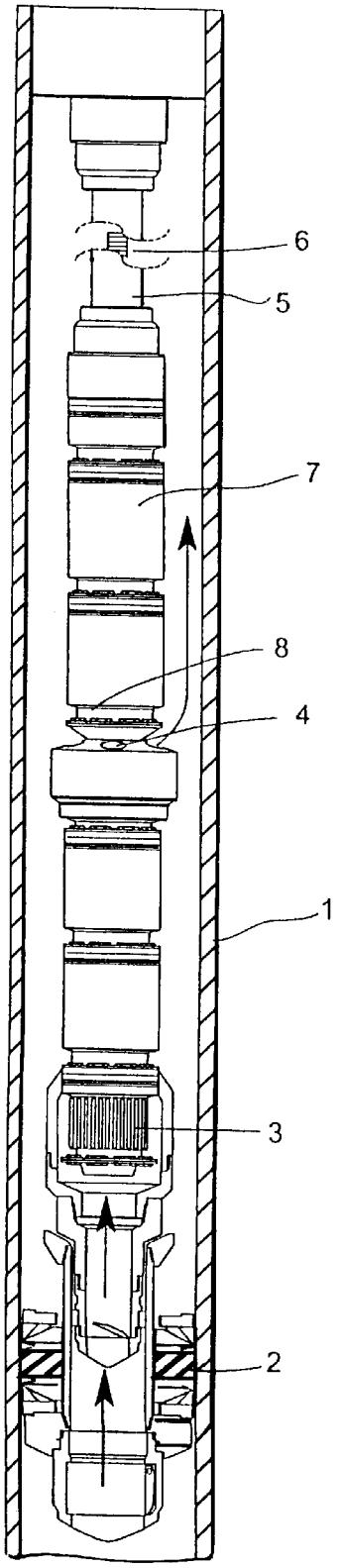
FIG. 1 PRIOR ART
FIG. 1 shows a side view of a well with an ESP installed using coiled tubing deployment.
Figure 2:
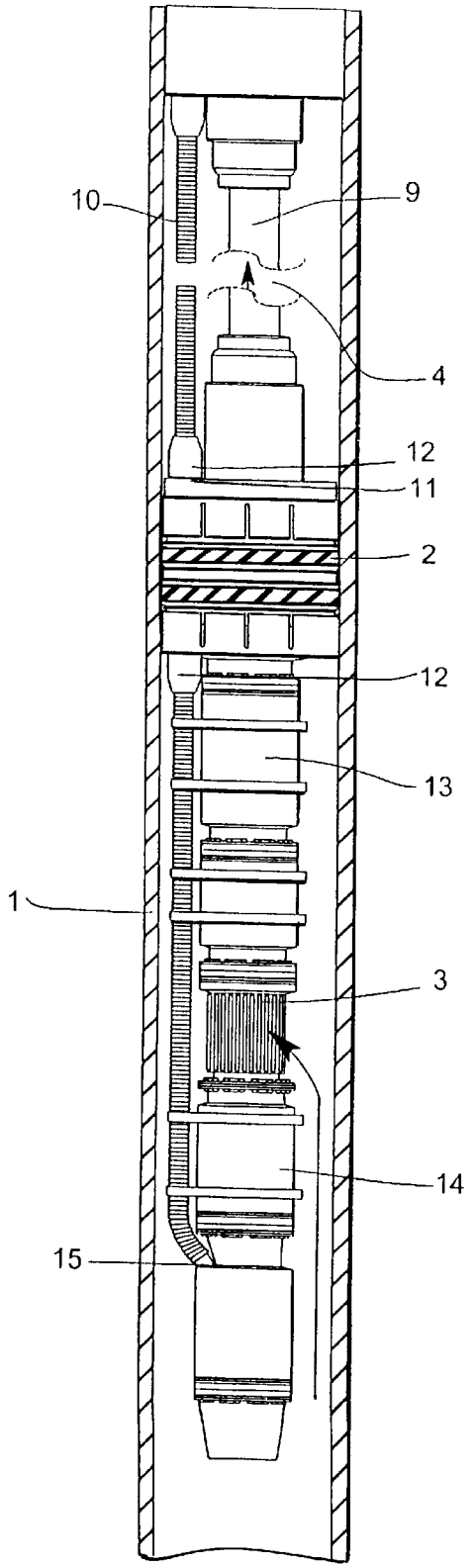
FIG. 2 PRIOR ART
FIG. 2 shows a side view of a well with an ESP installed using conventional jointed tubing and externally strapped power cable deployment.

Referring to FIGS. 1 and 2, these show the existing state of the art. FIG. 1 shows a coiled tubing deployed ESP. Well casing 1 provides a passage from the reservoir to the surface. A sealing device 2, generally referred to as a packer, separates the pump inlet 3 from pump discharge port 4. The ESP is supported by coiled tubing 5 which has a power cable 6 installed inside its bore, terminating directly into the electrical motor 7. The electric motor output shaft connects to the pump input shaft near 8, around which is the pump discharge port 4.

FIG. 2 shows the jointed tubing conveyed version of the electrical submersible pump. In this embodiment the jointed tubing 9 has an externally strapped power cable 10. The power cable is fed through the packer 2 by a penetrator (or electrical bulkhead) 11, the cable being terminated at either end of the penetrator by electrical cable terminations 12. The cable passes down the side of the pump section 13 and attaches to the electrical motor 14 via an electrical pot head connector 15.

Figure 3:
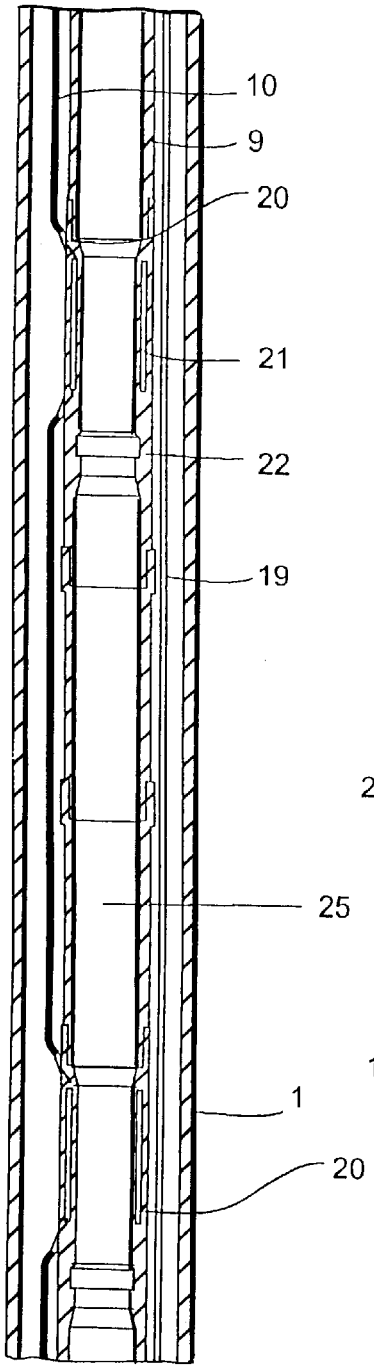
FIG. 3 shows a side view of a well with jointed tubing and externally strapped power cable connected to full bore docking ports incorporating electrical power coils.
Figure 4:
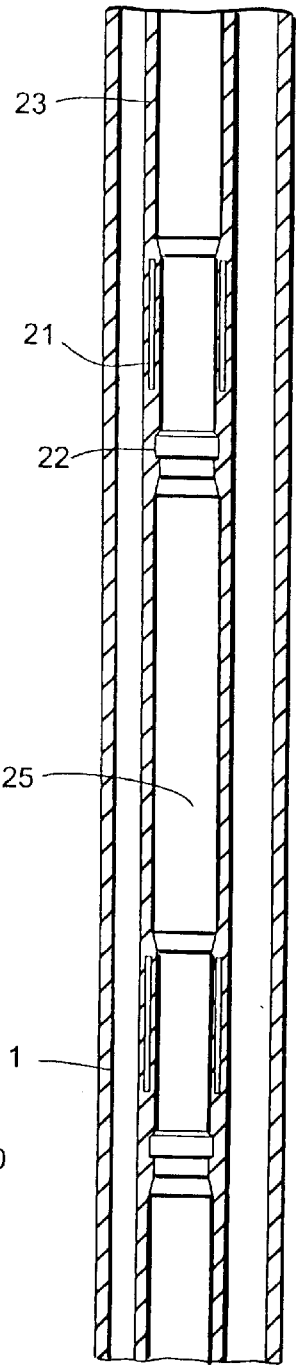
FIG. 4 shows a side view of a well with coiled tubing with internal power cable (not shown) connected to full bore docking ports incorporating electrical power coils.
Figure 4A:
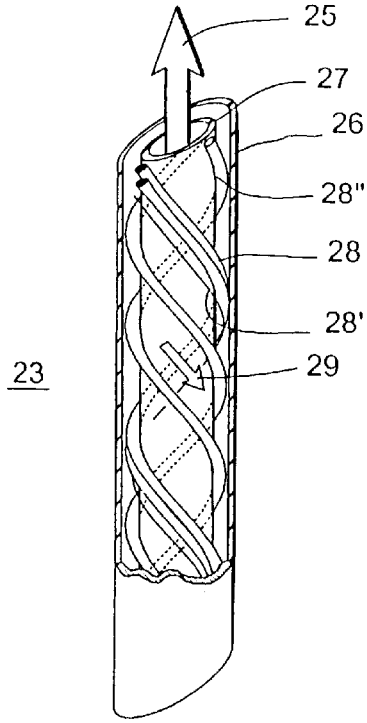
FIG. 4*a* shows a 3 dimensional perspective of twin-wall coiled tubing used in FIG. 4, forming a conduit for internal power and other cables.

It is clear from both of these embodiments that once any part of the ESP has failed the entire assembly has to be removed to be repaired or replaced. The most likely failures are of rotary seals, bearings and pump stages, which are moving parts unlike the cable, its connectors, and the motor windings. Referring to FIGS. 3, 4 and 4*a*, there are shown two embodiments of the present invention's well infrastructure. FIG. 3 shows jointed tubing, with an externally strapped power cable 10 terminated at one or more docking ports 20, and actuator fluid conduit 19. The docking ports contain electrical coils 21 and location profile 22. These items are permanently installed and not disturbed during workover operations. The coils may be permanently sealed in an insulating environment, such as oil, polyamide varnish, epoxy or elastomer filling.

Figure 5:
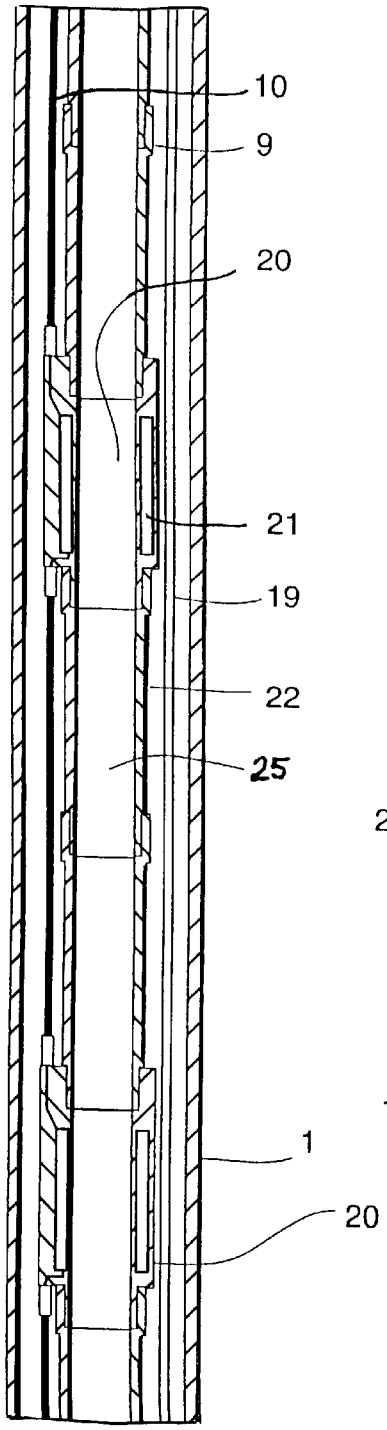
FIG. 5 shows a side view of another embodiment of a well with jointed tubing and externally strapped power cable connected to full bore docking ports incorporating electrical power coils.

A similar system where the jointed tube has no location profile is shown in FIG. 5. In such a system, it is necessary for the ESP to actively grip and support itself in the jointed tube's bore, as will be described in more detail below.

FIG. 4 shows a similar view to FIG. 3. In this embodiment the power cables are integral with the coiled tubing 23 and have not been shown for clarity. FIG. 4*a* shows two concentric coiled tubing skins 26,27. The annular space thereby formed houses the integral power wiring 28 and other well support infrastructure such as fiber optics 28' and hydraulic control lines 28".

Figure 6:
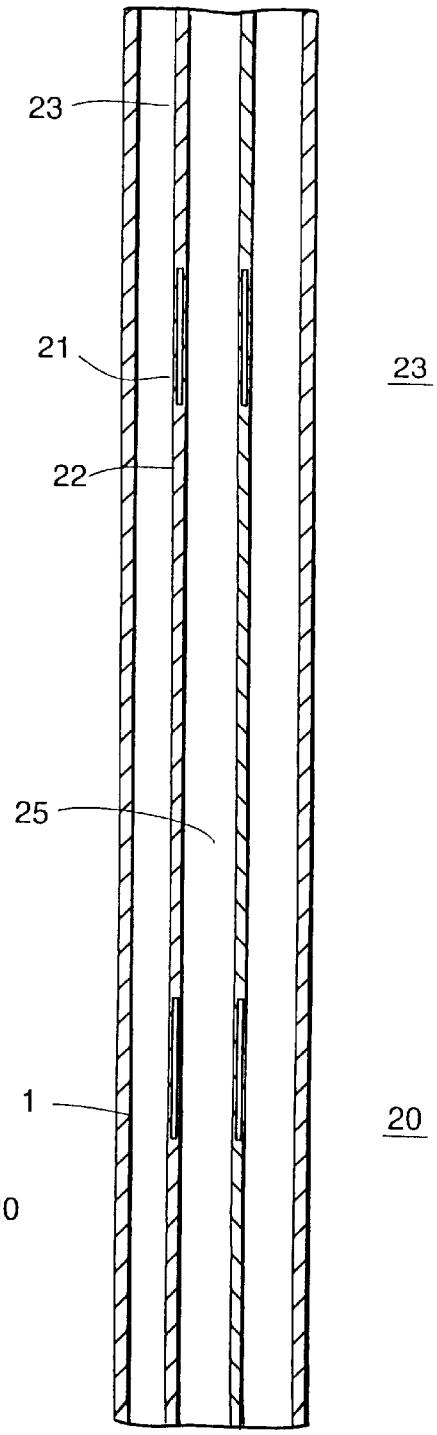
FIG. 6 shows a side view of another embodiment of a well with coiled tubing with internal power cable (not shown) connected to full bore docking ports incorporating electrical power coils.
Figure 6A:
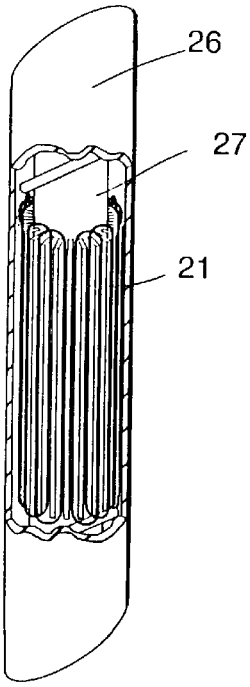
FIG. 6*a* shows a 3 dimensional perspective of twin-wall coiled tubing used in FIG. 6, showing the tubing's inductor arrangement.

Free space in the annulus may be used as a means of passing actuator fluid in place of a special line or the externally strapped flow tube 19 shown in FIG. 3. An embodiment where the coiled tubing has no engaging profile is shown in FIG. 6. Where no engaging profile is present, the ESP must actively grip the inner surface of the coiled tube to secure its position. Referring to FIG. 6*a*, the inductor elements are arranged radially in the thickness of the coiled tubing.

In all these embodiments there is full bore access 25 to the reservoir when no pumping modules are installed. This is beneficial for well operations which require the passage of, for example, higher flows, drilling and de-scaling equipment, and large modules. It will be apparent that these permanently wired docking stations can be used with other modules and are not restricted to pumping. A plurality of docking stations can be installed, with a mix of modules performing different functions simultaneously.

Figure 8:
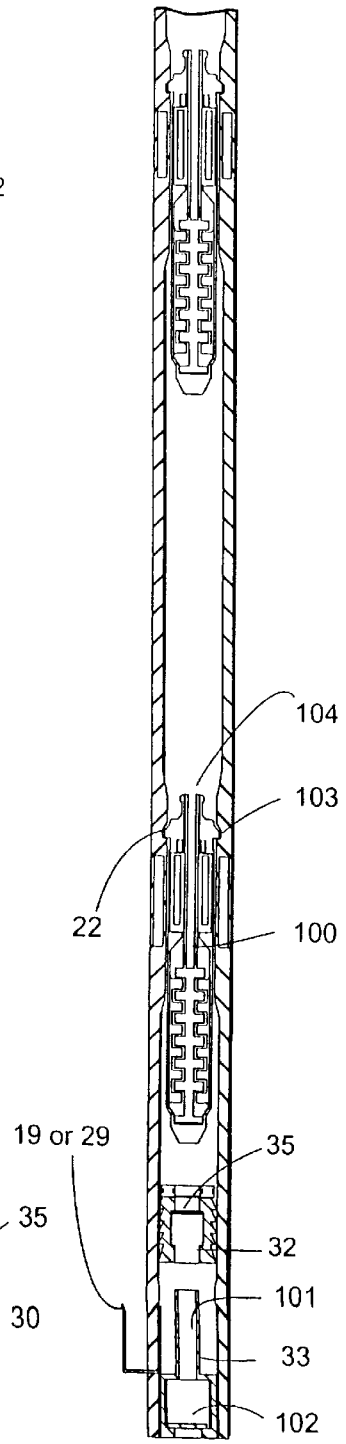
FIG. 8 shows a similar view to FIG. 7 with the pump out seal activated and moving up the tubing.
Figure 9:
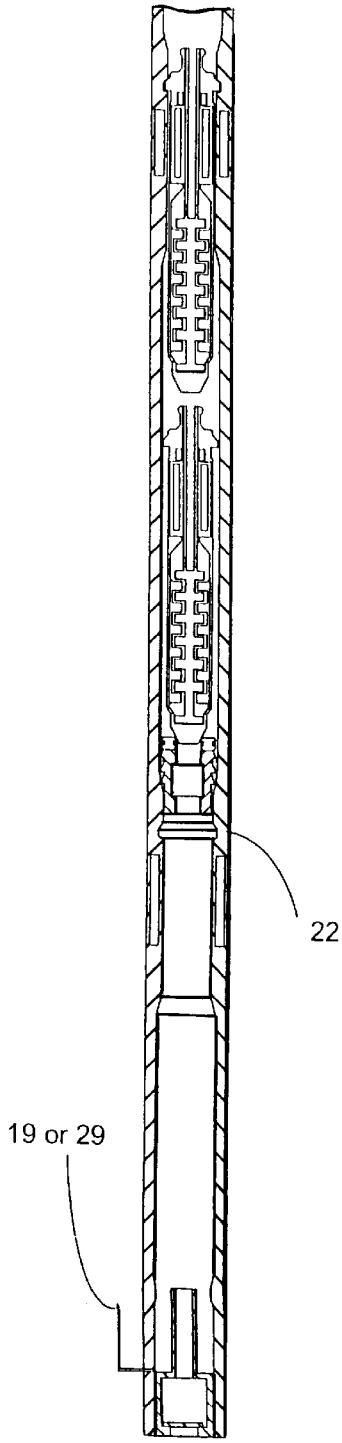
FIG. 9 shows a similar view to FIG. 7 with the pump out seal conveying one pump module out of the well and preparing to collect a second pump.

Retrieval and deployment of modules according to the invention will be explained with reference to FIGS. 7, 8 and 9. By way of example, these show two pumping modules installed in the coiled tubing completion of FIG. 4, but it will be apparent that the method to be explained will work in the jointed pipe completion of FIG. 3 and with any mix of module types. It will also be apparent that the non-return valves 30 and 35 may be of different types known in the art.

Figure 7:
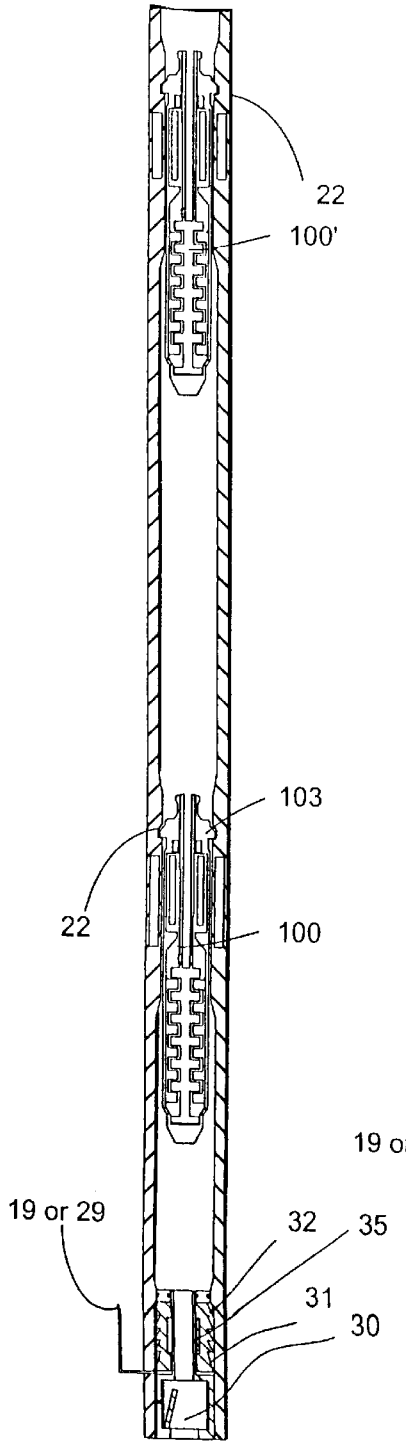
FIG. 7 shows a side view of a more detailed view of FIG. 4 of the lower section of the well with pump modules located in their docking stations and a pump out seal positioned, not in operation, at the lower most end of the tubing.

FIG. 7 shows upper 100' and lower 100 pump modules docked. They are held in position by integral collets 103 and location profiles 22. At the lower-most end of the tubing is a spring-loaded non-return valve 30, and a mechanical docking port 31 for a pump out seal 32. The seal fits over a hollow spigot 101 that is part of the docking port. The resultant small trapped volume between 31 and 32 is connected via an inlet to the aforementioned flow line 19 or 29. The seal carries a spring-loaded non-return valve 35 which is held open by the spigot 101 when in the docked position.

In normal operation flow in the well holds valve 30 open. To recover the pump modules, electrical power is first preferably turned off. Control fluid is pumped down the flow path inside the coiled tubing 29 and pressurizes the trapped volume 31', forcing the seal 32 to rise. When the seal eventually rises off the spigot 101, the valve 35 springs closed and blocks production flow. This equalizes pressure across valve 30, so that it springs shut, leaving a trapped volume 33 between the two valves 30 and 35. This volume is a large extension of the original volume 31', so that continued control fluid flow will now continue to move the seal up the tubing bore. When it reaches the lower pumping module 100 it removes the hanging weight from location collets 103, which unlatches them from their location profiles 22 in the tubing. By continuing to pump fluid down flow path 29 the pump module 100 is displaced to the upper pump module 100'. Continued displacement unlatches this second module, and thence both back to surface. After a short period of time determined by the flow rate in 29 the modules are all recovered back to surface where they can be either repaired or replaced.

To reinstall the pump modules the reverse operation is performed. A new pump out seal is first installed. This allows the lowering of all the pump out modules at a controlled descent rate. It will be appreciated that if a lower pumping module is still operating correctly, this could be used to pump out the pump modules above it.

If pumping out is not preferred, or the pump out seal fails, a wire-line or slick-line could be lowered which would connect to a fishing profile 104 on top of each module to allow their recovery one by one. Alternatively, particularly in horizontal sections, the modules could be deployed and retrieved using autonomous or wireline powered tractors.

The mechanical latch 22/103 may be varied according to particular requirements. For example, it may need spines to prevent rotation, as when supporting torque reaction from a pump. The details of such embodiments are covered by the present invention which discloses the principle of the docking port.

Figure 10:
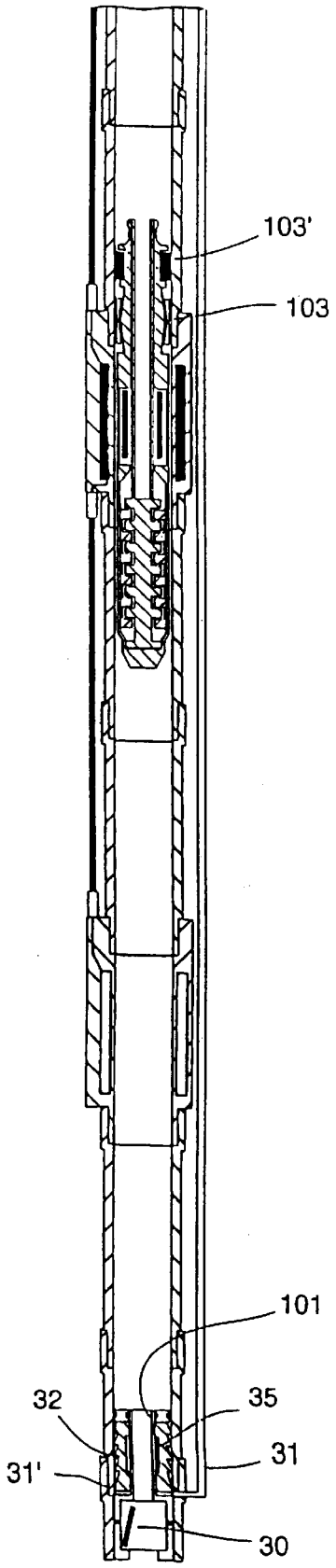
FIG. 10 shows another embodiment in a sectional view.
Figure 11:
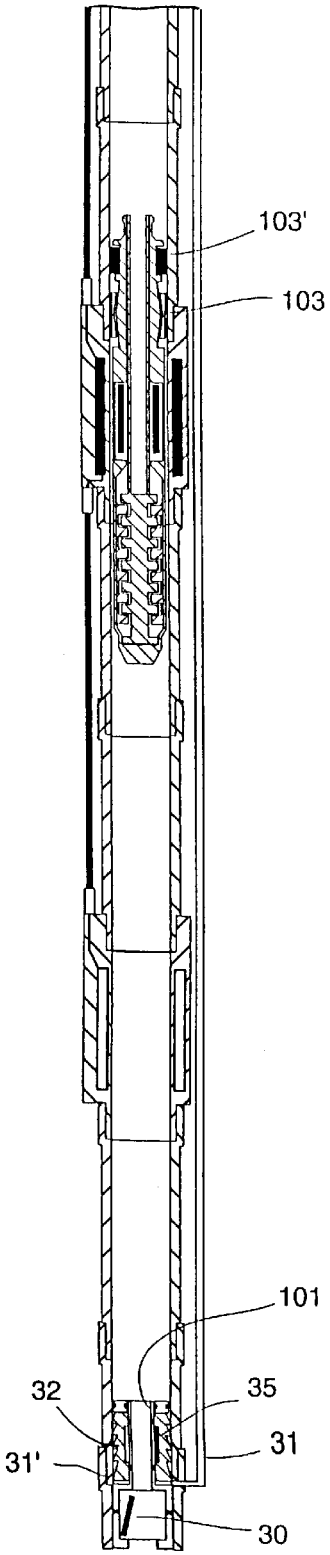
FIGS. 11 to 13 show another embodiment of the operation of the pumping modules within the tubing.
Figure 12:
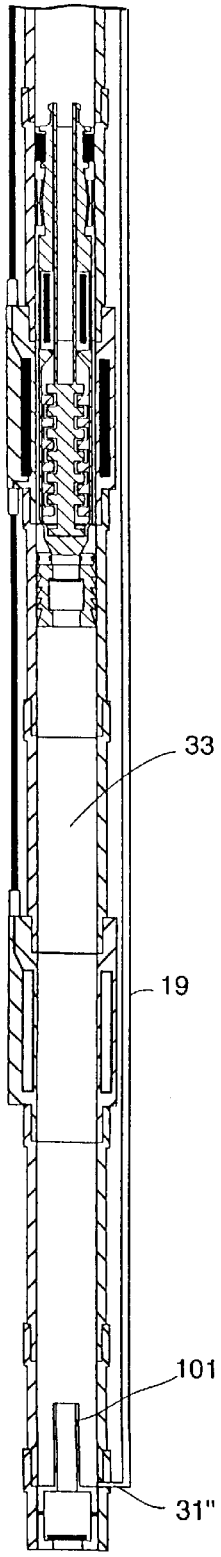
Figure 13:
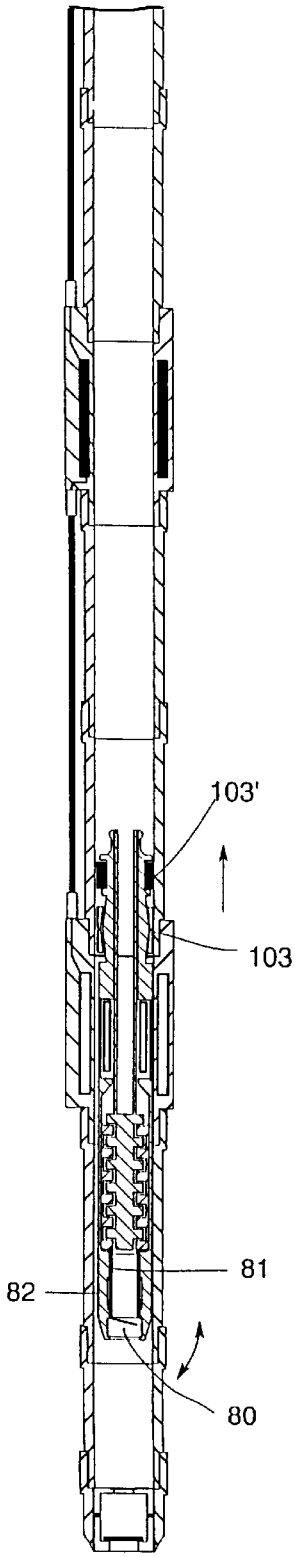

FIGS. 10, 11 and 12 show a similar system adapted for a jointed tubing system, the jointed tubing having no engaging profile and the pump anchoring and sealing itself against the inner surface of the tubing with slips 103 and seal 103' at the power transfer port 20. As before, at the lower-most end of the tubing is a spring-loaded non-return valve 30, and a mechanical docking port 31 for a pump out seal 32. The seal fits over a hollow spigot 101 that is part of the docking port. The resultant small trapped volume 31', between 31 and 32 is connected via an inlet 31" to the aforementioned flow line 19 or 29. The seal carries a spring-loaded non-return valve 35 which is held open by the spigot 101 when in the docked position.

The normal operation is similar to the previous system. The flow in the well holds valve 30 open. To recover the pump modules, electrical power is first preferably turned off. Control fluid is pumped down the flow path inside the coiled tubing 29 and pressurizes the trapped volume 31', forcing the seal 32 to rise, as shown in FIG. 11. When the seal eventually rises off the spigot 101, the valve 35 springs closed and blocks production flow. This equalizes pressure across valve 30, so that it springs shut, leaving a trapped volume 33 between the two valves 30 and 35. This volume is a large extension of the original volume 31', so that continued control fluid flow will now continue to move the seal up the tubing bore. When it reaches the lower pumping module 100 it removes the hanging weight from slips 103 and seal 103', which disconnects the pump module 100 from the inner surface of the tubing. By continuing to pump fluid down flow path 29 the pump module 100 is displaced up tubing. Continued displacement unlatches this second module (not shown), and thence both back to surface. After a short period of time determined by the flow rate in 29 the modules are all recovered back to surface where they can be either repaired or replaced.

To reinstall the pump modules the reverse operation is performed. A new pump out seal is first installed. This allows the lowering of all the pump out modules at a controlled descent rate. It will be appreciated that if a lower pumping module is still operating correctly, this could be used to pump out the pump modules above it.

If pumping out is not preferred, or the pump out seal fails, a wire-line or slick-line could be lowered which would connect to a fishing profile 104 on top of each module to allow their recovery one by one. Alternatively, particularly in horizontal sections, the modules could be deployed and retrieved using autonomous or wireline powered tractors.

The mechanical slips 103 may be varied according to particular requirements. For example, it may need splines to prevent rotation, as when supporting torque reaction from a pump. The details of such embodiments are covered by the present invention which discloses the principle of the power transfer port, and slips and seals used on the power transfer module.

FIG. 12 shows a module where the pump inlet contains a valve 80, which without power is held closed by a spring 81. The sleeve 82 is either electrically or hydraulically powered to keep the valve open. When closed, and the slips 103 released, hydraulic pressure can be applied below the valve via the port 31 which works as indicated by the arrows 83. This also works against the large moving seal 103' situated at the upper end of the module. Therefore rather than use a pump out seal, each individual pumping module could be pumped out, and lowered with full control. In a more sophisticated mode of operation the valve 80 could be used to lower the pump into the well. A battery operated control system fitted to the valve could monitor the rate of decent of the pump assembly and adjust the volume of fluid passed through the valve by alternately opening and closing the valve 80. Each pump and docking station would also have identification tags so that when the pump reaches the correct power transfer station its locating slips 103 will only become active to allow the pump to be located.

Figure 29:
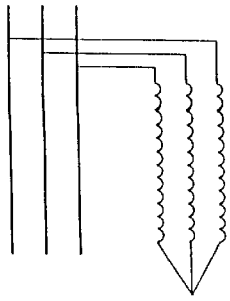
FIG. 29 is a schematic view of the wiring arrangement of a docking station.

The permanent electrical wiring of the docking stations depends on the module technology to be deployed. In the embodiments disclosed below, permanent magnet brushless motor technology is preferred. Typically the wiring to a docking station operated in isolation will be as shown in FIG. 29. In this case the motor is wound for three-phase AC power, and the three windings are joined to form a so-called star point. Several such docking stations may be connected together in this way on the same three power lines if the motors are run synchronously. However greater flexibility is obtained by using permanently installed, conservatively rated, power electronics to commutate the motors individually at each station. Where only a few pumps are required it may be feasible to wire the docking stations separately back to surface.

Referring to FIGS. 14 to 23 there are shown various embodiments of the pumping modules. Each of these will be described in more detail as follows.

Figure 14:
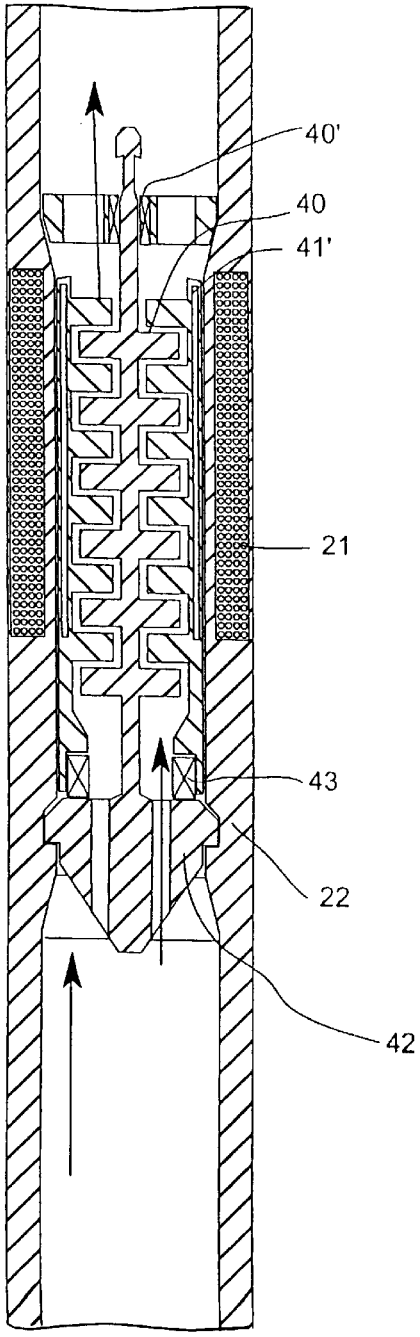

FIG. 14 shows the docking station 22 and embedded coils 21. The pump, of centrifugal type, comprises an inner stator 40 and an outer rotor 41. The module locates in the profile 22 and allows flow to pass through it via ports 42. The pump rotor 41 sits in a thrust bearing housing 43 and is supported by bearings 43'. The stator 40 is stabilized at the top by a support 40'.

Permanent magnets 41' are mounted on the circumference of the rotor, and in conjunction with the coils 21 form a brushless dc motor whose operating principles are well known in the art. The magnets are protected from the well fluids by means of a thin non-magnetic sleeve made for example from stainless steel or composite material. The inner bore of the docking port opposite the coils 21 is similarly protected, with the structural strength of the tubing being maintained by the coil core and outermost housing. It is an advantage of this type of motor and other permanent magnet motor types and their associated electrical drives that they may be designed with a relatively large gap between magnets 41' and coils 21. This permits robust construction with good electro-mechanical performance. By contrast the most widely-used downhole pump motors are of the well-known induction motor type. This requires transformer action between coils 21 and coils on the stator. This transformer action is gravely weakened with large gaps and renders induction motors non-preferred for the purposes of the present invention.

Figure 15:
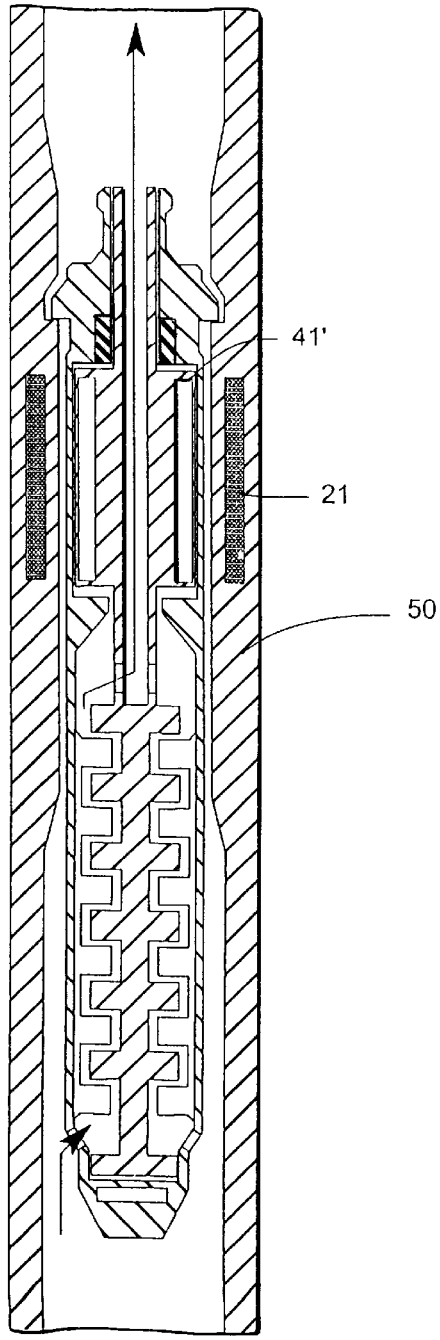

The pump vanes may be made metallic as commonly found, or made of damage resistant composite material. It will be apparent that the concentric motor-pump arrangement is applicable to other pump types that may be used in this application such as but not restricted to positive displacement pumps, turbine pumps, impeller pumps.

Where the tubing diameter restricts the concentric design lift or flow rate capacity or where it is preferred to incorporate a conventional pump product, or it is preferred to have the pump rotate internal to its stator then the motor and pump can be separated along the axis of the tubing, with the pump above or below the motor. FIG. 15 shows an embodiment of such a pumping module with stator coils 21 and rotor magnets 41.

Figure 16:
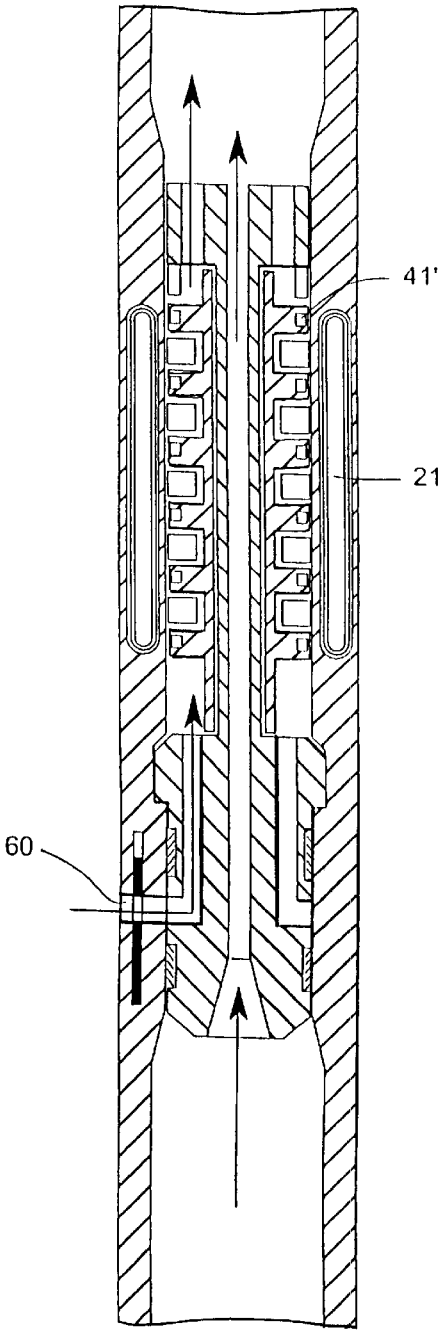

FIG. 16 shows an alternative pumping arrangement where the docking station has a valve 60 which allows fluid to be produced adjacent to the pump. This is particularly important in long horizontal sections of a well where it is preferable to even the drawdown along the length of the reservoir.

Figure 17:
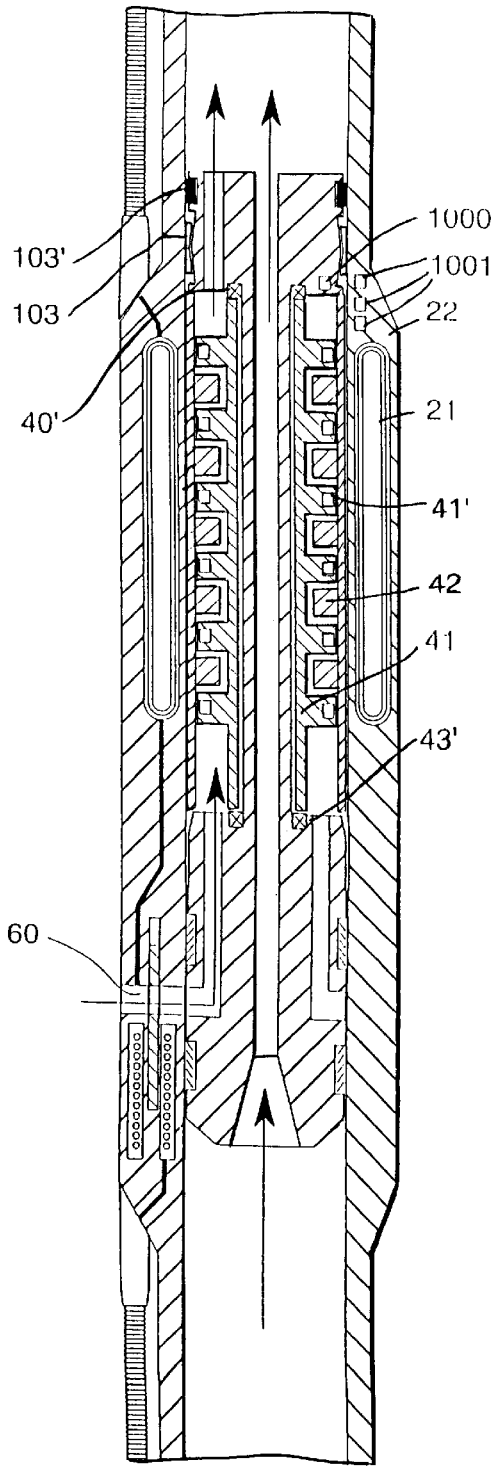

Referring to FIG. 17, in an alternative arrangement the module locates using an ID tag 1000 in the tool housing and tag 1001 in the deployed module, and slips 103 and seal 103' hold the pump stationary against the tubing and withstand reactive torque and thrust loads that the module is subjected too. Flow passes through from outside the tubing via ports 60.

Figure 18A:
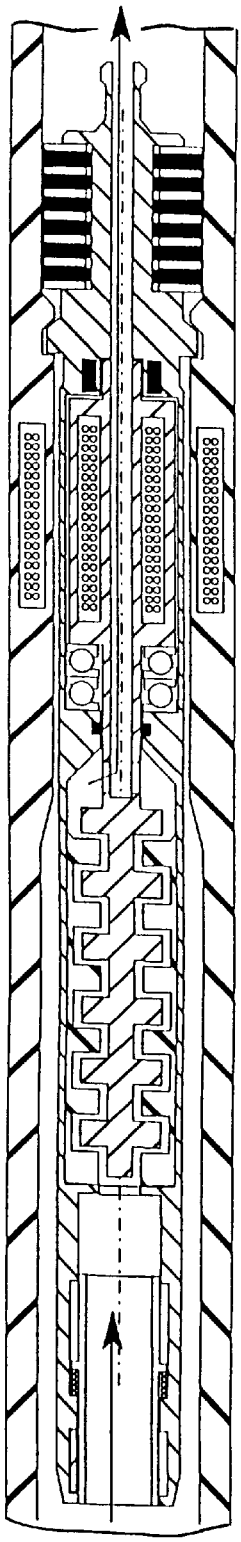
Figure 18B:
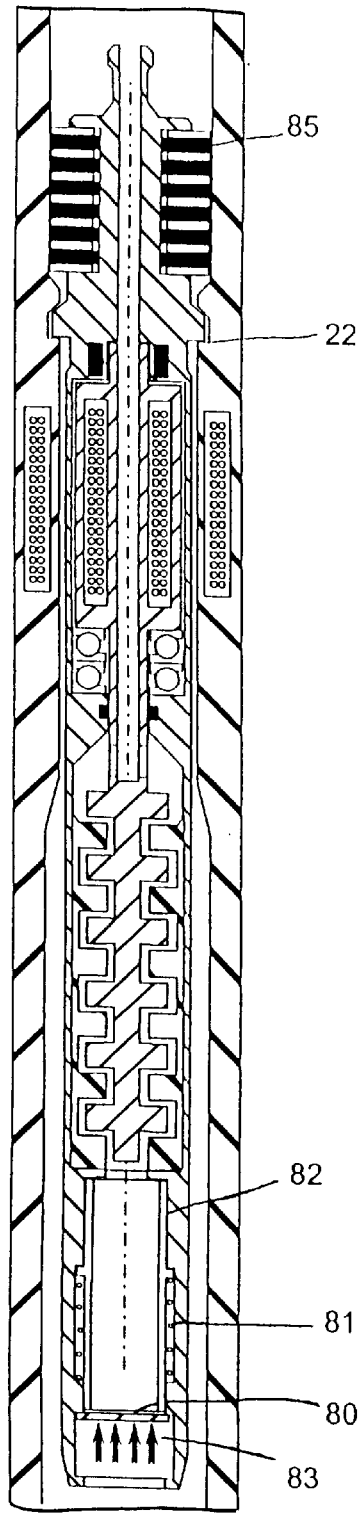

FIGS. 18*a* and *b* show a further embodiment of a pumping assembly. The pump inlet contains a valve 80, which without power is held closed by a spring 81. The valve seals a conduit with runs through the pump. The sleeve 82 is either electrically or hydraulically powered to keep the valve open. When closed, and the landing profile 22 released, hydraulic pressure can be applied below the valve via the port 31 which works as indicated by the arrows 83. This also works against the large moving seal 85 situated at the upper end of the module. Therefore rather than use a pump out seal, each individual pumping module could be pumped out, and lowered with full control. In a more sophisticated mode of operation the valve 80 could be used to lower the pump into the well. A battery operated control system fitted to the valve could monitor the rate of decent of the pump assembly and adjust the volume of fluid passed through the valve by alternately opening and closing the valve 80. Each pump and docking station would also have identification tags so that when the pump reaches the correct docking station its locating dogs will only become active to allow the pump to be landed. Instruments may be passed down the pump's conduit if desired.

In the case of a gas pipeline the pumps, concentrically or axially disposed with respect to the motor, can be turbine impellers rotated at very high rpm to compress gas to assist in transporting it along the pipeline or to re-inject it back into the oil production path to assist in reducing the hydrostatic pressure or re-energize the reservoir.

FIG. 19 shows a similar rotor and stator arrangement where the pump uses dynamic seals and gripping means to engage with the inner surface of tubing not having an engaging profile.

Figure 20:
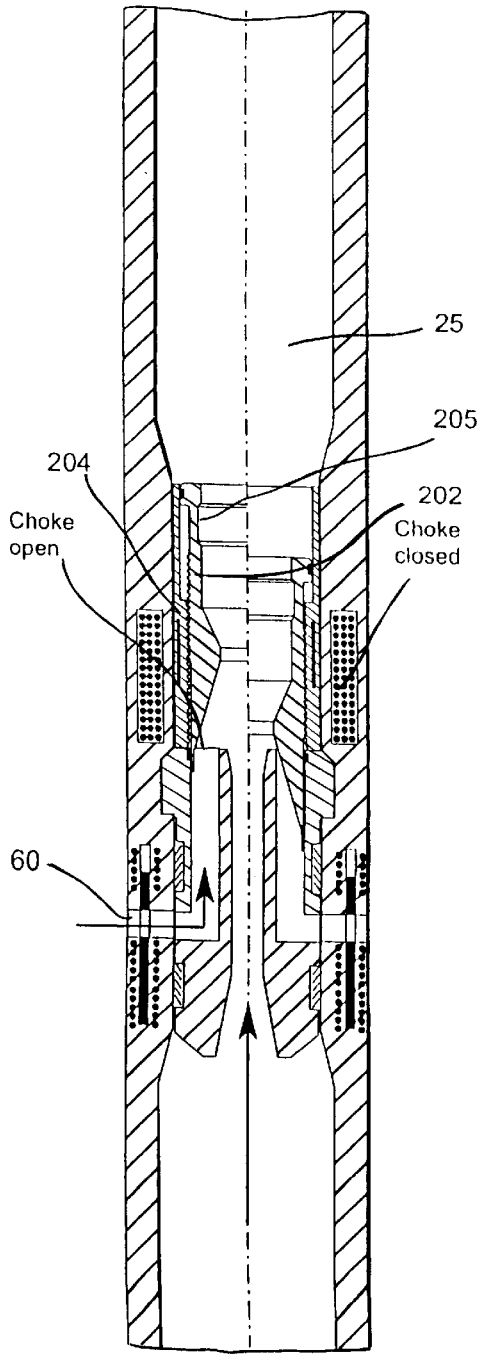
FIG. 20 shows a side view of a docked electrically actuated flow control module.

FIG. 20 shows a flow regulator having a local reservoir inlet valve in split view. The left side shows the throttle sleeve 202 fully open and the right side shows it fully closed. Flow control port 60 is opened and closed by an on/off solenoid shuttle valve 200. Flow passes through the port 60 and passage 201 into the main bore 25. At the exit of the flow passage 201, a variable flow are can be achieved by moving the sleeve 202 towards the passage opening 201 or away from the passage opening. The precise position of sleeve 202 is maintained by the motor formed from permanent stator coils 203 and rotor magnets on the threaded sleeve 204. Threaded sleeve 204 engages in threads on sleeve 202, so converting motor rotation to linear actuation of sleeve 202. When it is necessary to recover this valve to surface, solenoid valve 60 is closed and motor 203/204 is deactivated. A pump out seal 32 can be used to recover this assembly to surface as previously disclosed herein. Alternatively, an internal fishing profile 205 may be machined into 202, so a wireline or coiled tubing recovery method can be employed.

Linear sleeve motion may also be obtained by direct use of a linear motor, in which the rotor magnet poles are disposed along the length of sleeve 204 instead of circumferentially, and the winding 203 topology is modified accordingly as is known in the art. Then sleeve 204 and throttle 205 move axially together and need not be separate parts. Linear motors may be used where the forces involved are not very high, and end-stops may be used to restrain motion in the case of unexpected flow surges.

Figure 21:
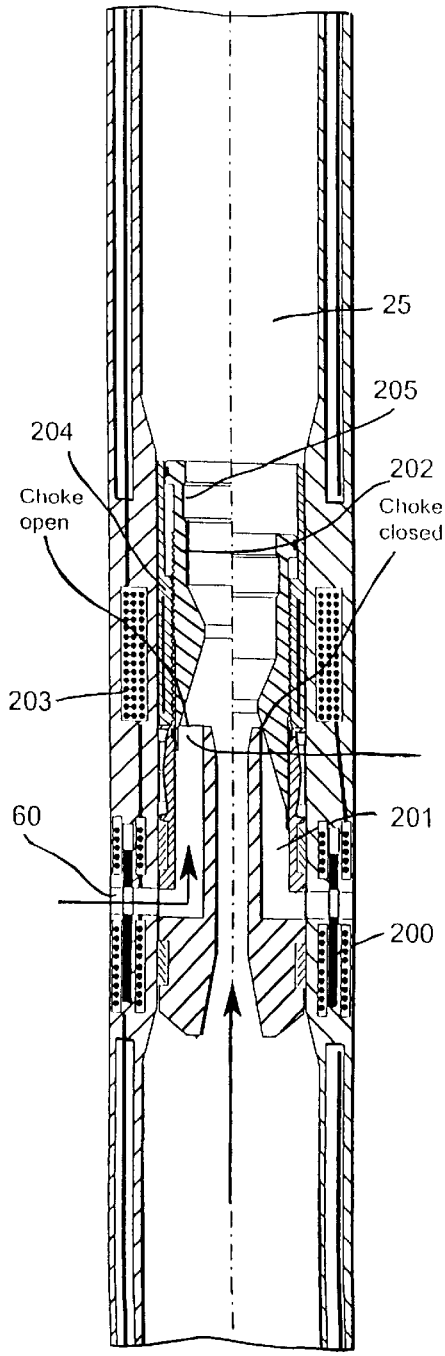
FIG. 21 shows another embodiment of an electrically actuated flow control module.

FIG. 21 shows a similar system, however the pump employs a gripping means to secure itself in position, as the tube has no engaging profile.

Figure 24:
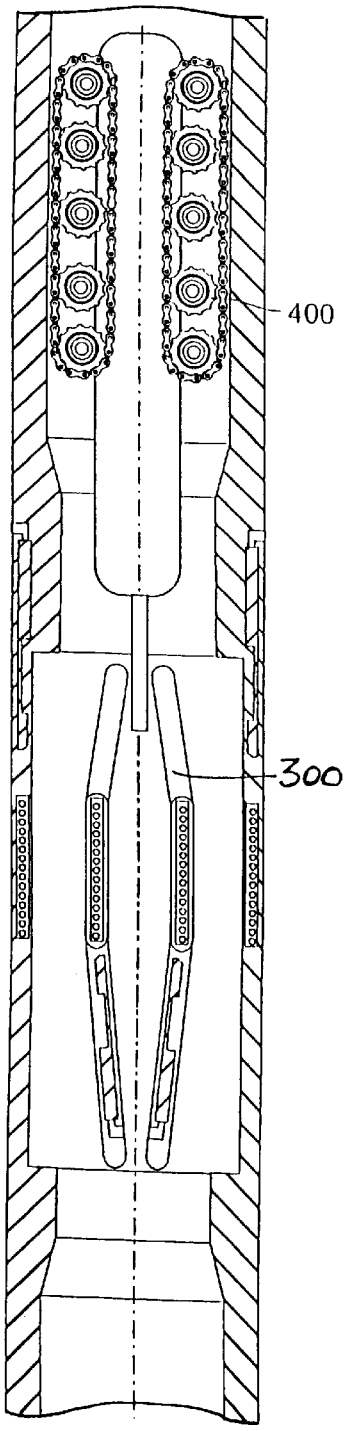

FIGS. 22 to 24 show an internally deployed sensor assembly 300. The assembly is expandable so that when it docks it is retained in the internal profile 301, leaving the tubing bore at full gauge. The assembly may be powered and communicate back to surface using inductive coupling through the tubing wall to permanently installed instrument wires. When it is necessary to recover the sensor, a battery powered self propelled tractor 400 can be sent into collect it or a pump out seal 32 can be used.

Figure 25:
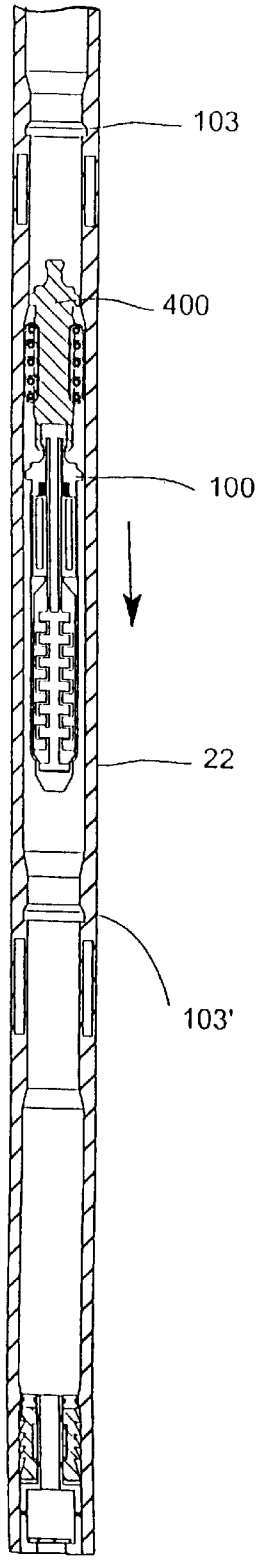
FIGS. 25 to 27 show side views of another embodiment of operating the system.
Figure 26:
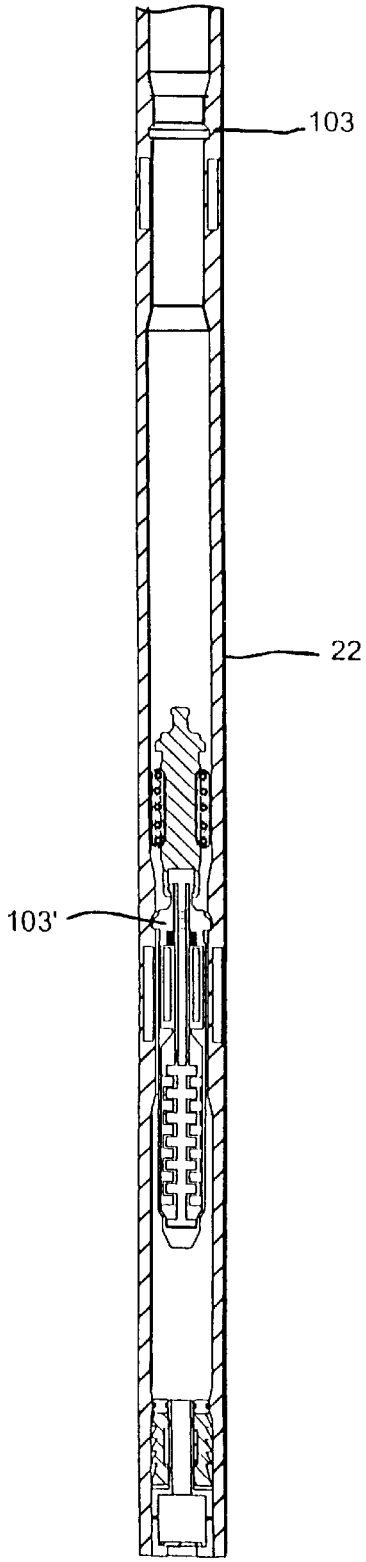
Figure 27:
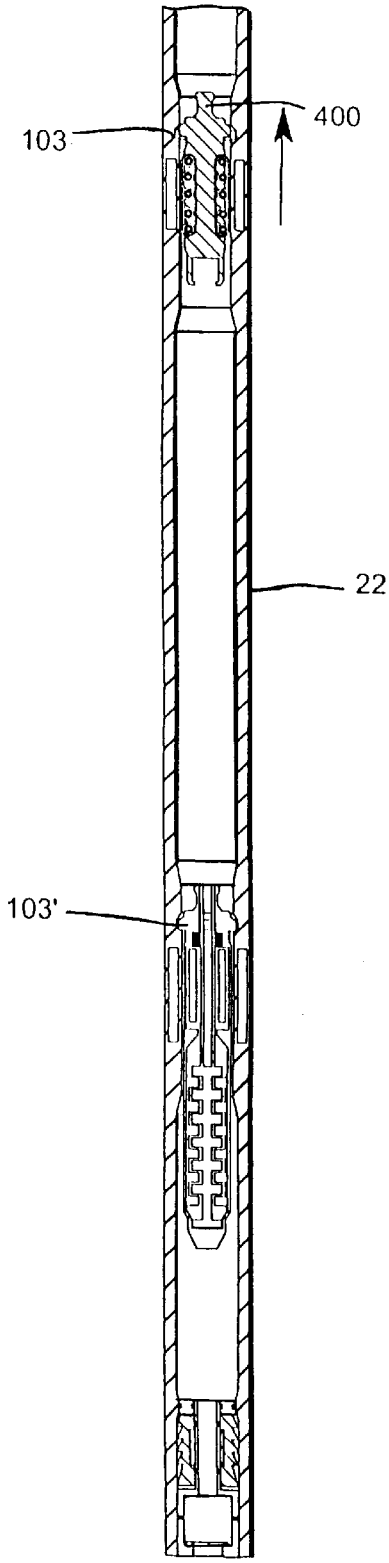

Next referring to FIGS. 25 to 27, there is shown a further embodiment of the system. A self-propelled tractor 400 is conveying an electrically powered pumping module 100 into the well. It is shown having passed one docking station 22 and is continuing down the tubing to dock in the docking station 22'. Once located and landed in the docking port 22' the tractor will either recharge its batteries or begin immediately to crawl its way back to surface. If it needs to recharge its batteries on the way back to surface it can stop at a docking port 22 and recharge them.

Figure 28:
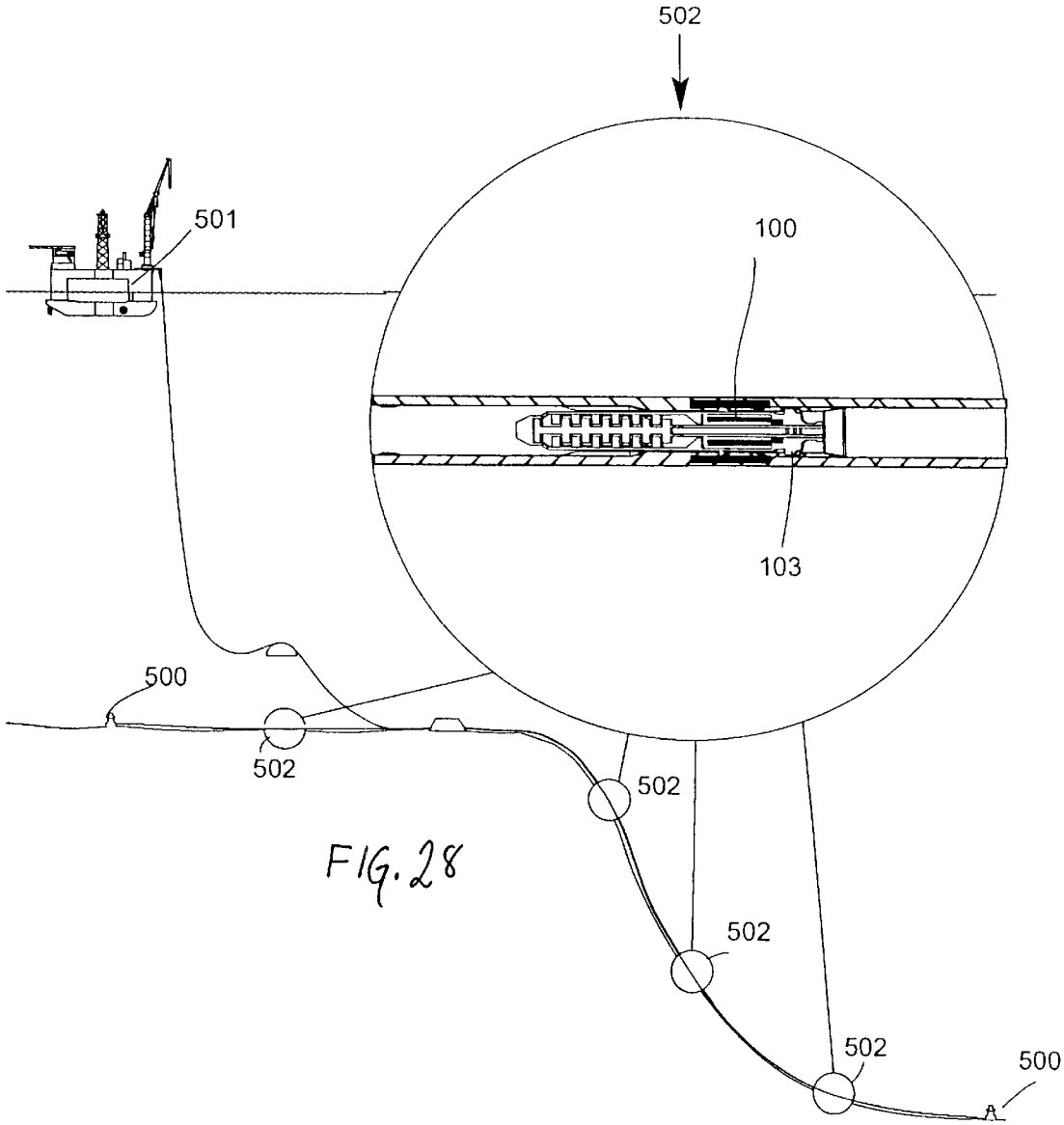
FIG. 28 shows a side view of a floating production vessel in the ocean with a flow line linking it to subsea wellheads, said flow line containing docking ports.
Figure 30:
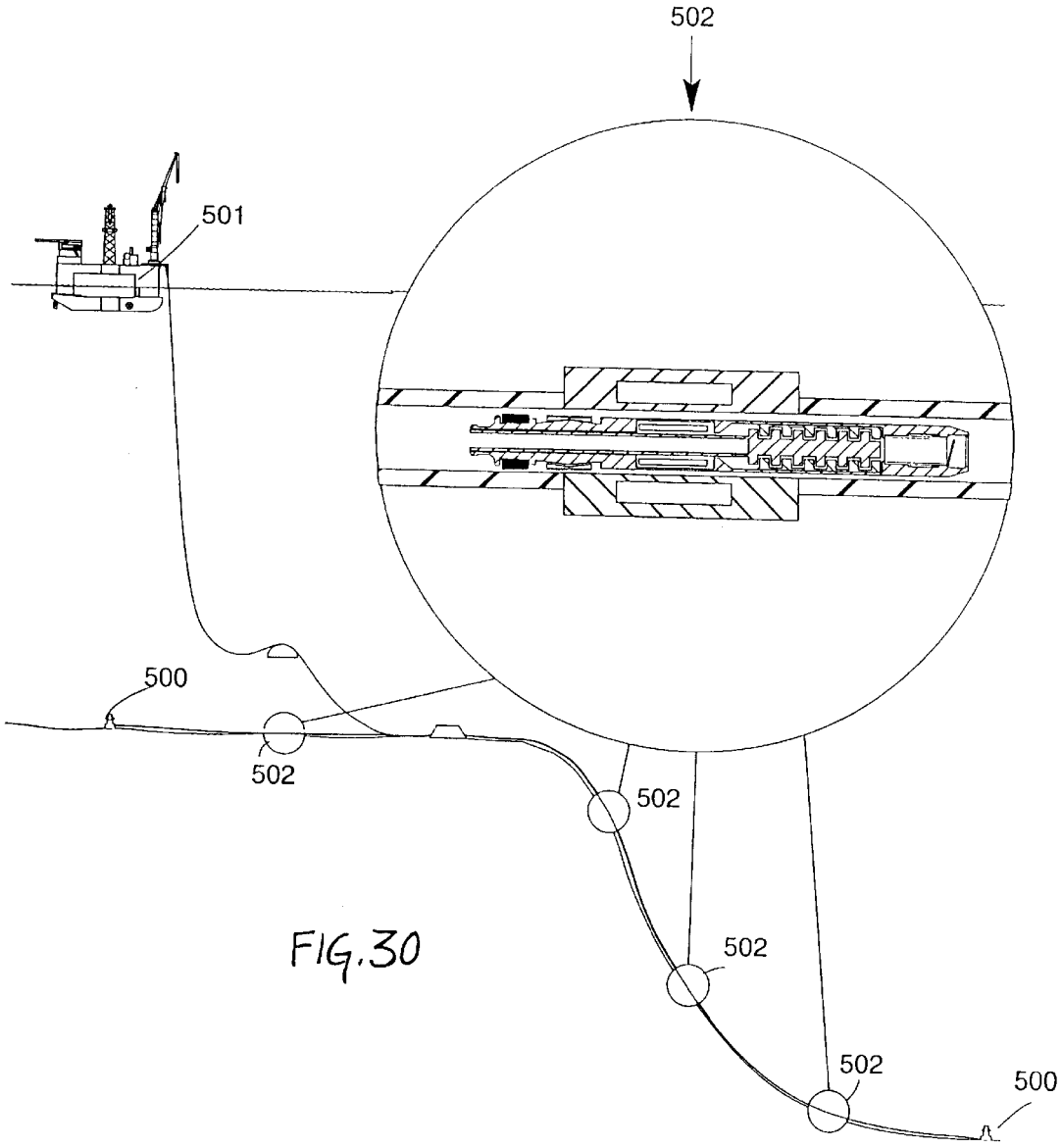
FIG. 30 shows another embodiment of the system shown in FIG. 28.

The foregoing embodiments have emphasized the application to wells. FIG. 28 depicts the use of the invention in flow-lines connecting sub-sea wellheads 500 back to a floating production vessel 501. Because of the horizontal and vertical distances involved it is advantageous to install booster pumps along the flow-lines' length. These are indicated by circles 502. At each of these locations is an internal docking port 22 and an electrically driven pump similar to the devices described earlier. A further benefit of the retrievable module approach is to avoid very expensive diver and remotely operated vehicle (ROV) intervention. Referring to FIG. 30, the engaging profiles may be absent from the flowline, in which case the pumps are provided with dynamic gripping and/or sealing means.

The invention's main objective is to provide an economical means of performing advanced well electrical completions with greatly reduced maintenance costs and enhance flexibility. The deployment and recovery means disclosed can also be applied to non-electrical equipment such as hydraulic submersible pumps.

Alternative embodiments using the principles disclosed will suggest themselves to those skilled in the art, and it is intended that such alternatives are included within the scope of the invention, the scope of the invention being limited only by the claims.

What is claimed is:

1. An oil flow line and powered device system comprising:

a tube for the transportation of oil having an electrical conductor disposed along at least some of its length, and including a docking profile on its inner surface;

at least one powered device including:

a body shiftable along said tube;

a rotor mounted rotatably in said body;

magnets attached to said rotor, and means on said body engagable with the docking profile to retain said body in position along said tube.

2. An oil flow line and powered device system according to claim 1 wherein the powered device includes a sealing means around the powered device to provide a seal between the outer surface of the powered device and the inner surface of the tube.

3. An oil flow line and powered device system according to claim 1 wherein the powered device is a pump.

4. An oil flow line and powered device system according to claim 1 wherein the tube is disposed in a borehole.

5. An oil flow line and powered device system according to claim 1 wherein the tube and the powered device both have co-operating signal transfer means for signal transfer between said tube and the powered device.

6. An oil flow line and powered device system according to claim 1 wherein the tube has a plurality of locating profiles upon an inner surface of the tube.

7. An oil flow line and powered device system according to claim 1 wherein a plurality of said powered devices are disposed in the tube.

8. An oil flow line and powered device system according to claim 1, further comprising a traction means which interacts with the inner surface of the tube so as move the powered device along the tube.

9. An oil flow line and powered device system according to claim 8 wherein the powered device is a pump.

10. A method of disposing and operating a powered device in a oil flow line comprising:

introducing a powered device into a tube for the transportation of oil, the powered device including magnets attached to a rotor, which is rotatably mounted in the body of the powered device, the tube having an electrical conductor disposed along at least some of the length of the tube, and including a docking p profile on an inner surface of the tube, engaging the powered device with the docking profile of the tube in a manner that resists inducted torque, and supplying power to an electric power transfer means connected to the electrical conductor, and thereby inducing a force on the magnet to cause the rotor to turn, operating the powered device.

11. A method of operating an oil pipeline, comprising the steps of:

(a) providing along a length of tubing forming an oil pipeline a plurality of inductive power transfer stations spaced along said pipeline and electrically energized by at least one conductor in a wall of said tubing;

(b) displacing a plurality of pumps along said tubing toward a remote end thereof and positioning said pumps at least at some of said stations, each of said pumps being formed with a pump body and a pump rotor having magnets cooperating with the respective power station to cause rotation of the respective rotor relative to the respective pump body and displacement of oil along said pipeline;

(c) engaging each of said bodies with said tubing at a respective one of said stations to resist torque generated upon rotation of the respective rotor; and (d) de-energizing said inductive power transfer stations, disengaging said bodies from the tubing for repair of the pipeline, and displacing said pumps along said tubing away from said remote end.

12. The method defined in claim 11 wherein said pumps are displaced along said tubing away from said remote end by pressurizing said tubing between said pumps and said remote end with a liquid pressure sufficient to displace said pumps.

13. The method defined in claim 11 wherein said pumps are displaced in said tubing by a crawler engaging an inner wall of said tubing and said crawler has a rechargeable power source, said method further comprising the step of recharging said power source by positioning said crawler at one of said power transfer stations and electrically energizing same.

* * * * *